US005553847A

United States Patent [19]

Surrency

[11] Patent Number: 5,553,847

[45] Date of Patent: Sep. 10, 1996

[54] VERSATILE PITCHER TRAINING AND PROFICIENCY DEVICE

[76] Inventor: Tim Surrency, 11311 N.E. 40th Street Rd., Silver Springs, Fla. 34488

[21] Appl. No.: 444,675

[22] Filed: May 19, 1995

[51] Int. Cl.[6] ..... A63B 69/40

[52] U.S. Cl. ..... 273/26 R

[58] Field of Search ..... 273/55 A, 55 R, 273/55 B, 1.5 R, 26 R

[56] References Cited

U.S. PATENT DOCUMENTS

| | | | |
|---|---|---|---|
| 3,398,954 | 8/1968 | Nedwick | 273/55 R |
| 3,804,406 | 4/1974 | Viscione | 273/1.5 A |
| 3,998,456 | 12/1976 | Sherman | 273/55 A |
| 4,208,050 | 6/1980 | Perrine | 273/1.5 A |
| 4,836,542 | 6/1989 | Crawley | 273/55 B |
| 4,936,578 | 6/1990 | Hudson | 273/55 R |

*Primary Examiner*—Theatrice Brown
*Attorney, Agent, or Firm*—Low & Low

[57] ABSTRACT

There is disclosed a versatile pitcher training and proficiency device which is focussed upon learning and thoroughly conditioning proper throwing arm motion through ball release and followthrough, as distinct from accuracy and control training to throw a ball to a particular location in a strike zone, for example. A lightweight and readily portable framework and surface supporting members provide specific targets for the hand of the throwing arm during its arc of movement. Adjunct means locates a pitching rubber zone to facilitate accurate training. The device is adjustable for various pitcher physiques, pitching styles, and techniques.

15 Claims, 1 Drawing Sheet

FIG. 1
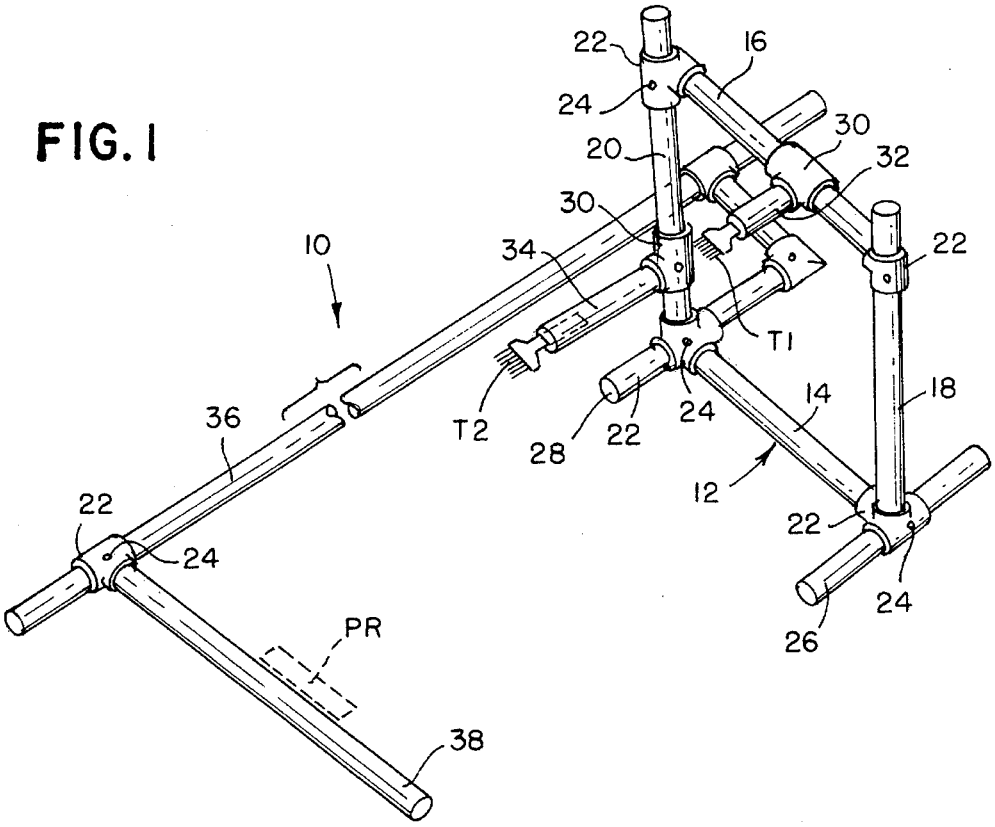
FIG. 2
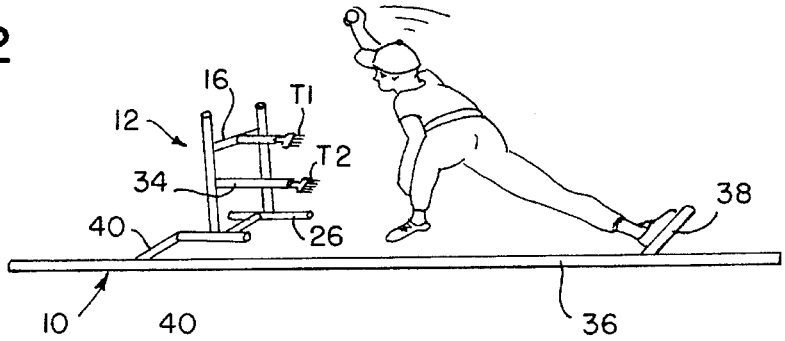
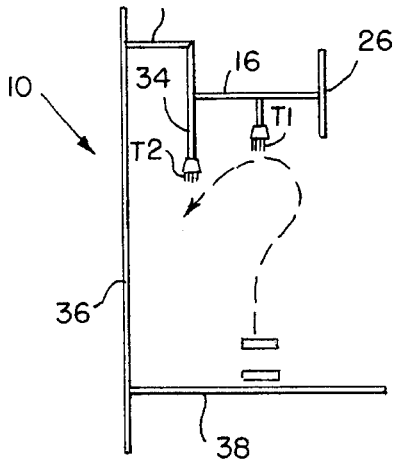
FIG. 3

VERSATILE PITCHER TRAINING AND PROFICIENCY DEVICE

BACKGROUND OF THE INVENTION

There has been much development of training equipment for baseball pitchers, or indeed for athletes in other sports requiring throwing motions, for the purpose of teaching accuracy in the throw of a ball. Thus, the prior art includes, inter alia, diverse devices for defining a "strike zone" over a representative "home plate", whereby the pitcher can learn the acceptable bounds of the strike zone in practicing pitching the ball to particular high, low, inside, or outside areas thereof.

These devices are concerned with being able to achieve a desired positioning of the moving ball as it approaches and enters the strike zone, whether fast ball, curve, knuckle ball or the like.

This goal of accuracy in ball positioning in flight over the plate is difficult to achieve unless the pitcher has learned proper physical motion of his or her arm during the pitch and followthrough as and after the ball is released. The pitching motion, whether following a full windup or an abbreviated windup, necessarily must be consistent and reliable and substantially uniform.

Only when this is achieved, is the pitcher better able to learn and control nuances of the pitch involving desired ball positioning over the plate, speed, curve, drop, etc., as desired by the pitcher or catcher. In the absence of trained and consistent throwing motion of the arm, controlled positioning and movement of the ball as it reaches the batter is considerably more difficult and happenstance.

BRIEF SUMMARY OF THE INVENTION

The present invention provides a means for learning precise arm movement and control, whereby on each pitch as the pitcher steps forward from the pitching rubber, the path of movement of the arm will be consistent and uniform, whereby once this skill is attained as a virtually automatic motion, successful study and care can then be given to speed and position control of the ball as and after the ball is released, thereby to provide maximum pitching effectiveness.

While such training is necessary for all pitchers at any age, it is especially desirable for younger ballplayers who are first being well coached to learn proper pitching form and technique. Regular coached and personal practice with the device of the invention effectively instills in the pitcher a "muscle memory", whereby each time the pitcher takes a pitching stance on the pitching mound or at a pitching rubber, he or she can be assured that the arm throwing motion is conditioned and trained to follow the desired path as the ball is released. This "mucle memory" effect is well known wherein a specific physical action when repeated sufficiently essentialy becomes automatic or a body movement habit.

To this end, the device of the invention provides a unique framework preferably having two spaced targets which are to be briefly touched by the pitching hand or fingers of the pitcher as the pitcher's arm sweeps by in an arc during practice ball release and followthrough.

The framework may be positioned in any desired location, but most conveniently is supported on the ground or on a floor as by surface-engaging members lying thereagainst and connected to the target-supporting framework.

Further, the targets are readily adjustable and repositionable on the framework to accommodate the physical characteristics of height, arm length, etc., or the trainee, thereby to insure the most useful training position for any particular individual. In like manner, the targets may be repositioned as desired for overhand or sidearm practice for the trainee, and the device includes positionable means to indicate a pitching rubber or pitching mound area for the trainee.

The device is also lightweight, easily assembled or disassembled and stored, and durable for the purposes intended.

BRIEF DESCRIPTION OF THE DRAWINGS

The invention will be better understood in connection with the accompanying drawings, in which:

FIG. 1 is a perspective view of the pitcher training apparatus of the invention;

FIG. 2 is a diagrammatic perspective view of the relationship of the device to a trainee; and, FIG. 3 is a simplified overhead view generally indicating an illustrative curved path of a throwing hand.

DESCRIPTION OF THE PREFERRED EMBODIMENT

Referring to the drawings, the training device of the invention is shown generally at 10, and includes a primary upstanding framework 12 carrying targets T1 and T2. Framework 10 includes lower horizontal member 14, upper horizontal member 16, and right and left vertical standards 18, 20. The members are, conveniently for light weight, ease of handling, and durability, lengths of plastic pipe, but obviously may comprise other forms as rods or X-shaped extrusions or the like. The same are detachably coupled together as by plastic elbow, sleeve, or Tee joint members 22, wherein locking means as set screws 24 are provided as needed in the couplings to frictionally connect the members and to permit ready detachment and disassembly thereof.

In like manner, there are provided surface-engaging pipe or similar members 26, 28 which are slidably and lockably secured in the sleeve couplings, and thereby permit the framework 12 to stand self-supported on the ground or on a gymnasium floor, for example.

The upper horizontal member 16 carries a further slidable Tee fitting 30 secured as desired in adjusted position along member 16 by like set screw means. A short member 32 projects forwardly from fitting 30 and carries the target T1, such as a tined or soft bristled brush, extending forwardly therefrom. Similarly, left-hand standard 20 has a like fitting 30 which carries a projecting member 34 somewhat longer than that at 32, which member 34 carries the second target T2.

For simplicity, the targets T1 and T2 may be handled brushes, whose handles are detachably frictionally received within the forwardly projecting members 32, 34, or may be any other suitable material that will not injure the hand or fingers of a trainee using the device.

While the aforesaid framework 12 alone and its surface engaging members 26, 28 are elementally sufficient for "muscle memory" pitching training, it is preferred to also provide an elongated surface-engaging member 36 extending forwardly of the framework along one side thereof, and having another coupling element 22 thereon from which a cross member 38 extends along the ground or floor surface in substantially parallel relation to the framework 12. The elongated member is preferably attached to framework 12 as by a short connector member 40 and associated conventional couplings.

Member 38 is especially desirable as providing a locus or indicator of a pitching rubber zone to give the trainee a fixed point from which the trainee can take a pitching stance for throwing motions. The trainee can visualize the member 38 as being adjacent an imaginary pitching rubber PR in effecting practice.

In like manner, with elongated member 36 providing a measured connection between the framework 12 and the adjustably positioned pitching rubber zone cross member 38, the pitching coach or the trainee can readily effect desired spacing adjustments for the height, reach, etc. of any particular trainee.

It will be seen that in the form shown, the target T1 is above and somewhat to the right of target T2, as would be applicable to a right handed overhand pitcher. Further, target T1 is slightly further away from the trainee than target T2, as perhaps emphasized in FIG. 3. Target T1 essentially represents the farthest reach of the pitcher's hand as it swings through the pitching arc, and at or about the point of ball release. The target T1 is so positioned with respect to the physique of the trainee that the fingers or knuckles of the pitching hand will brush against and through the target, when the trainee is effecting a desired pitching motion as instructed by a coach.

Repetitive throws, therefore, similarly arc through target T1, thereby conditioning the mind and muscle of the pitching trainee to the proper throwing arm arc, whereby the same becomes automatic and reflexive.

Similarly, target T2 which projects slightly further toward the trainee, and is below and left of target T1, is brushed by the pitching hand when a proper arc of follow through motion is achieved by the trainee, as generally illustrated in FIG. 3. With continuous practice, with or without a ball, although with a ball is preferred for better control and "feel", the body of the trainee becomes adapted to the muscle control requirements for proper pitching arc, and achieves the highly desirable muscle memory for repetitive, reliable pitching form for enhanced ability and ball control.

As the trainee gains skill, the pitching rubber zone indicating member 38 can be moved further from the targets to enhance the stretch of the pitcher, as well as other pitching control movements. Further, a single target T1 alone may be employed until a novice pitcher begins to get the feel and rhythm of the arm arc, and thereafter the second target may be employed to enhance the proficiency, as aforesaid.

It is evident that by merely switching target T2 from vertical standard 20 to standard 18 that left-handed practice may be effected. Further, for example, the target T1 may be moved to near the top of right-hand standard 18 for right-handed sidearm pitching practice. The demountability and rearrangeability of the several parts of the device provide maximum versatility for different pitching styles or pitcher physical characteristics.

In one specific embodiment of my invention which has proven itself in actual use, the framework 12 has had the vertical standards 18, 20 about two feet apart while the top rail 16 is positioned just under two feet above the surface with target T1 centered thereon and somewhat below the rail, extending forwardly about 6". Target T2 was about 10" above the ground surface, extending forwardly just over 1'. The pitching rubber zone or mound indicating member 38 was about 3' long and approximately 7' from the targets.

As indicated, all these dimensions are freely adjustable in my device to accommodate the physical characteristics of any pitcher or as desired by a coach.

While I have described one preferred working embodiment of my invention, it is evident that the concept and function thereof may take differing and modified forms with departing from the spirit and scope thereof as defined in the appended claims.

Thus, illustratively, while the preferred embodiment deals with training of young baseball pitchers and their throwing motion, the device is equally operative for related and other throwing training purposes, as training an outfielder to make long and accurate throws back to the infield, for example, wherein the muscle memory training provided by the invention is also very useful and valuable in ensuring that the outfielder or other player has a reliable and repetitive throwing motion, especially under the pressure of base runners, crowd enthusiasm, and the like. Also, and particularly in connection with these other embodiments, the trainee may hold a ball, a small towel, or other small object in the throwing hand to provide mass or throwing resistance, and this object may actually be used to touch the target or targets, instead of utilizing direct hand/target contact.

What I claim is:

1. A versatile pitcher training and proficiency device for imparting muscle memory to a baseball pitcher thereby to insure a conditioned arm movement in throwing the ball, comprising, an upstanding framework of predetermined height, means for supporting the framework on a subjacent surface in a selected position, a manually engageable target mounted on said framework and projecting forwardly thereof for brief contact with the hand of a trainee pitcher performing a baseball pitching motion of the arm toward the target, and, means cooperatively associated with said framework and engaging said surface for indicating a positioning area as a pitching rubber zone to the trainee in laterally spaced relation to and forwardly of said target.

2. The versatile pitcher training and proficiency device of claim 1 including a second manually engageable target mounted on said framework and projecting forwardly thereof and in vertically spaced relation to said first target, said second target projecting forwardly from said framework a greater distance than said first target for brief contact with the hand of a trainee pitcher performing a baseball pitching motion of the arm toward the target.

3. The versatile pitcher training and proficiency device of claim 2 wherein said framework includes a vertical member and a horizontal member to which said targets are respectively attached.

4. The versatile pitcher training and proficiency device of claim 3 wherein said supporting means include surface engageable members attached to said framework to support said framework said subjacent surface.

5. The versatile pitcher training and proficiency device of claim 4 including means for adjusting the position of said frame work along said supporting means to obtain a desired practice position for a trainee.

6. The versatile pitcher training and proficiency device of claim 4 wherein said framework and said supporting means are formed from lightweight polymeric pipe and pipe couplings.

7. The versatile pitcher training and proficiency device of claim 4 wherein said framework and targets are readily repositionable to accommodate right- or left-handed pitcher trainees.

8. The versatile pitcher training and proficiency device of claim 3 including means for adjusting the position of each of said targets respectively on said horizontal member and said vertical member to obtain a desired practice position for a trainee.

9. The versatile pitcher training and proficiency device of claim 2 including means for adjusting the respective location of said targets on said framework as required for pitcher trainees of differing physical characteristics.

10. The versatile pitcher training and proficiency device of claim 2 wherein said targets are flexible members which readily yield when contacted by the trainee's hand.

11. The versatile pitcher training and proficiency device of claim 10 wherein said flexible members are deflectable brush bristles extending in a direction toward the position of a trainee.

12. A versatile throwing motion training and proficiency device for imparting muscle memory to a baseball player thereby to insure a conditioned arm movement in throwing the ball, comprising, a framework, means for supporting the framework in a selected position, a manually engageable target mounted on said framework and projecting forwardly thereof for brief contact with the hand of a trainee baseball player performing a baseball throwing motion of the arm toward the target, a second manually engageable target mounted on said framework in vertically spaced relation to said first target, said second target projecting forwardly from said framework a greater distance than said first target, thereby providing vertically spaced targets of differing lengths for brief respective contact with the hand of a trainee pitcher performing a baseball pitching motion of the arm toward the targets, and, means cooperatively associated with said framework and engaging said framework supporting means for indicating a positioning area as a pitcher's rubber zone to a trainee in laterally spaced relation to and forwardly of said targets.

13. The versatile throwing motion training and proficiency device of claim 12 including means for adjusting the respective horizontal and vertical location of said targets on said framework as required for pitcher trainees of differing physical characteristics.

14. The versatile throwing motion training and proficiency device of claim 12 wherein said targets are flexible members which readily yield when contacted by the trainee's hand.

15. The versatile throwing motion training and proficiency device of claim 14 wherein said flexible members are deflectable brush bristles extending in a direction toward the position of a trainee.

* * * * *